US007832486B2

(12) United States Patent
White et al.

(10) Patent No.: US 7,832,486 B2
(45) Date of Patent: Nov. 16, 2010

(54) FLAPPER GAS LIFT VALVE

(75) Inventors: Thomas White, Spring, TX (US); James Garner, Pearland, TX (US); David McCalvin, Missouri City, TX (US); Tyson Messick, Bartlesville, OK (US); Fahd F. Abdelall, Houston, TX (US); Kenneth C. Burnett, III, Bartlesville, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 35 days.

(21) Appl. No.: 12/138,150

(22) Filed: Jun. 12, 2008

(65) Prior Publication Data

US 2009/0044947 A1 Feb. 19, 2009

Related U.S. Application Data

(60) Provisional application No. 60/956,069, filed on Aug. 15, 2007.

(51) Int. Cl.
*E21B 34/06* (2006.01)

(52) U.S. Cl. ..... 166/373; 166/319; 166/372

(58) Field of Classification Search ..... 166/372, 166/373, 332.8, 319
See application file for complete search history.

(56) References Cited

U.S. PATENT DOCUMENTS

| | | | | |
|---|---|---|---|---|
| 2,511,488 | A | 6/1950 | Westman | |
| 4,248,308 | A | 2/1981 | Pringle | |
| 4,986,357 | A * | 1/1991 | Pringle | 166/319 |
| 5,004,007 | A | 4/1991 | Johnson et al. | |
| 5,257,663 | A | 11/1993 | Pringle et al. | |
| 5,535,828 | A | 7/1996 | der Kinderen et al. | |
| 6,227,299 | B1 | 5/2001 | Dennistoun | |
| 7,360,602 | B2 | 4/2008 | Kritzler et al. | |
| 7,464,763 | B2 * | 12/2008 | Galloway et al. | 166/372 |
| 2007/0095542 | A1 | 5/2007 | Lembcke et al. | |
| 2007/0181312 | A1 | 8/2007 | Kritzler et al. | |
| 2008/0121397 | A1 * | 5/2008 | Galloway et al. | 166/305.1 |

FOREIGN PATENT DOCUMENTS

| | | | |
|---|---|---|---|
| EP | 1727962 | B1 | 1/2008 |
| GB | 2441633 | A | 3/2008 |
| WO | 19953170 | A1 | 10/1999 |
| WO | 2005093209 | A1 | 10/2005 |
| WO | 2007089933 | A1 | 8/2007 |

* cited by examiner

*Primary Examiner*—Shane Bomar
(74) *Attorney, Agent, or Firm*—Kevin B. McGoff; Rodney V. Warfford; Tim Curington

(57) ABSTRACT

A gas lift valve has a flow restrictor, a valve part on one side of the flow restrictor, a flow deflector and a tubular member on another side of the flow restrictor, and a flapper valve on the side of the flow restrictor where the tubular member is located, the flapper valve being adjacent to the tubular member. When fluid flows into the gas lift valve at sufficient pressure, the valve part opens, the fluid flows through the flow restrictor and acts on the flow diverter thereby moving the tubular member and opening the flapper valve. The tubular member extends though the opening the flapper valve covered.

18 Claims, 3 Drawing Sheets

FLAPPER GAS LIFT VALVE

CROSS-REFERENCE TO RELATED APPLICATIONS

This application claims the benefit of the filing date of U.S. Provisional Application No. 60/956,069 filed Aug. 15, 2007, entitled "PRESSURE OPERATED NOZZLE VENTURI/FLAPPER GAS LIFT VALVE," filed on Aug. 15, 2007, which is incorporated herein by reference to the extent permitted by law.

TECHNICAL FIELD

The present application generally relates to the field of valves used in wells, and in particular, gas lift valves used in hydrocarbon wells.

BACKGROUND

Fluids are located underground. The fluids can include hydrocarbons (oil) and water, for example. Extraction of at least the oil for consumption is desirable. A hole is drilled into the ground to extract the fluids. The hole is called a wellbore and is oftentimes cased with a metal tubular structure referred to as a casing. A number of other features such as cementing between the casing and the wellbore can be added. Also, completions tubing and devices can be located inside the casing. The wellbore can be essentially vertical, and can even be drilled in various directions, e.g. upward or horizontal.

Once the wellbore is cased, the casing is perforated. Perforating involves creating holes in the casing thereby connecting the wellbore outside of the casing to the inside of the casing. Perforating involves lowering a perforating gun into the casing. The perforating gun has charges that detonate and propel matter through the casing thereby creating the holes in the casing and the surrounding formation and helping formation fluids flow from the formation and wellbore into the casing.

Sometimes the formation has enough pressure to drive well fluids uphole to surface. However, that situation is not always present and cannot be relied upon. Artificial lift devices are therefore sometimes needed to drive downhole well fluids uphole, e.g., to surface.

One such artificial lift device is a gas lift. A gas lift forces gas downhole and into the well fluids to lower the density of the well fluids thereby assisting lifting to the surface. Involved with gas lifts can be, for example, gas lift valves.

SUMMARY

An embodiment of features in the present application can include a gas lift valve, comprising:

a longitudinally extending tubular body defining an inner volume and an inner diameter;

a flow restrictor within the tubular body defining an opening there through having an inner diameter that is smaller than the inner diameter of the tubular body, thereby defining a first side of the flow restrictor and a second side of the flow restrictor;

a valve part located on the first side of the flow restrictor, the valve part being movable between a first position and a second position, the first position being in contact with the flow restrictor thereby restricting flow through the flow restrictor, and the second position not being in contact with the flow restrictor and allowing flow though the flow restrictor, the valve part being actuated by pressure on the first side of the flow restrictor;

an opening in the tubular body fluidly connecting an outside of the gas lift valve to an inside volume of the gas lift valve on the first side of the flow restrictor;

a longitudinally extending tubular device located inside the tubular body on the second side of the flow restrictor, the tubular device being longitudinally movable inside the tubular body;

a flow deflector located on the second side of the flow restrictor, the flow deflector being mechanically connected with the tubular device so that the flow deflector and the tubular body move in tandem;

a flapper valve located within the tubular body and adjacent to an end of the tubular device that is distal from the flow restrictor, the flapper valve having a first closed position wherein the flapper valve covers an opening though the tubular body, and a second open position wherein the flapper valve allows flow though the tubular body; wherein when in the first position the tubular device is proximate to the flow restrictor thereby allowing the flapper valve into the first closed position covering the opening and when the tubular device is in the second position the tubular device extends though the opening and is distal to the flow restrictor thereby preventing the flapper valve from moving to the first closed position.

Other systems, methods, features, and advantages will be or will become apparent to one with skill in the art upon examination of the following figures and detailed description.

DETAILED DESCRIPTION

While embodiments will be described below with reference to the accompanying drawings, the specific structures and descriptions which follow are illustrative and exemplary of a broad scope, and are not to be construed as limiting embodiments.

As used here, the terms "above" and "below"; "up" and "down"; "upper" and "lower"; "upwardly" and "downwardly"; and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate.

A gas lift valve can operate or actuate (open and close) by a pneumatic process that allows pumped or injected lift gas or fluid to mix with crude oil or well fluid in a production tubing, thereby reducing the density of the crude oil or well fluid, and enhancing the production rate of the well. The injection gas or fluid is provided to an annulus between the production tubing and wellbore, and injected into the valve via one or more mandrels (e.g., side pocket) distributed along the production tubing. The valve controls the flow of the injection gas or fluid as it mixes with crude oil or well fluid in the production tubing.

When the annulus pressure of the injection gas or fluid exceeds a predefined threshold, the valve opens to allow the injection gas or fluid to be injected into the production tubing. When the annulus pressure is below the threshold, the valve is closed, thus at least substantially preventing injection gas or fluid from being injected into the production tubing. Gas lift valves can include a bellows-type actuation device that uses a combination of forces from the production tubing and annulus to regulate and selectively open or close the valve, often using a square edged orifice choke mechanism or a venturi style orifice.

Gas lift valves can include a reverse-flow check valve mechanism, often of the velocity check-type, to prevent well fluids from flowing in a reverse direction through the valve. However, a reverse-flow check valve mechanism can be relatively unprotected from the injection gas or fluid since they are included within the flow path, and thus can be subject to unacceptable erosion, corrosion, and other conditions that lead to gas leakage over time, causing hydrocarbons to be inadvertently released into the environment when well shut-in is required.

Accordingly, some embodiments described herein relate to a valve with a long-term, positive sealing system to provide systems with zero or minimal gas release when the system is closed.

Figure 1:
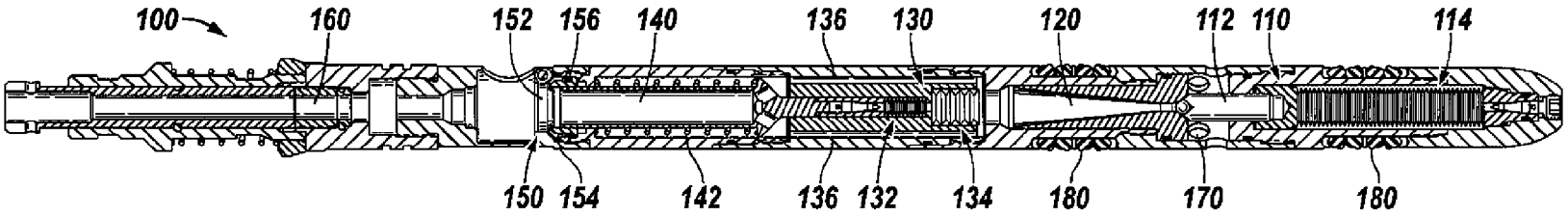
FIG. 1 is a schematic diagram of a valve shown in a closed position.
Figure 2:
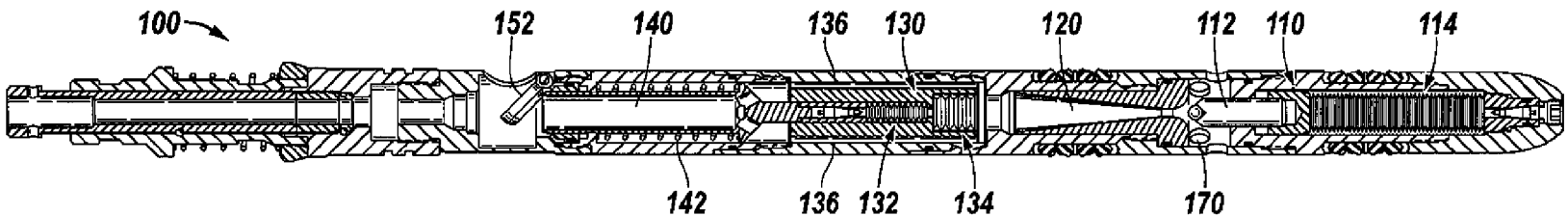
FIG. 2 is a schematic diagram of the valve of FIG. 1, shown in a half-open position.
Figure 3:
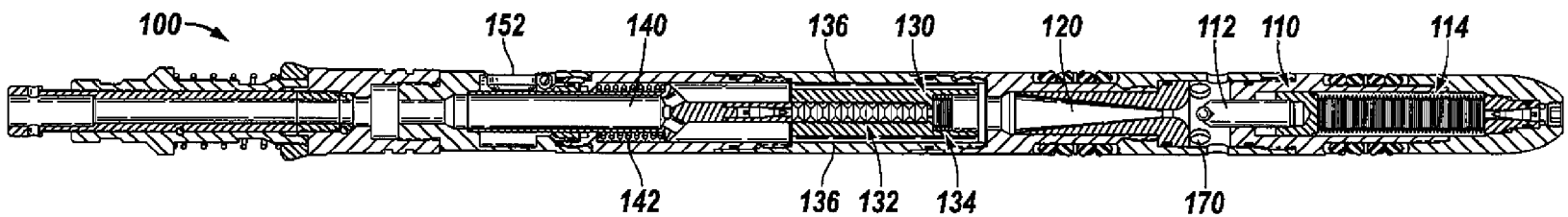
FIG. 3 is a schematic diagram of the valve of FIG. 1, shown in an open position.

FIGS. 1-3 depict schematic diagrams of a gas lift valve 100. FIG. 1 shows the valve 100 in a closed position. The valve 100 includes a ball stem and bellows assembly 110, venturi orifice 120, hydraulic system 130, tubular device 140, flapper system 150, and flow-thru latch 160. The ball stem and bellows assembly 110 is positioned at one end of the valve 100. The ball stem and bellows assembly 110 includes a ball stem 11 2, which interfaces with the venturi orifice, and bellows 114. The bellows 114 is filled with nitrogen charged gas. The ball stem 112 and bellows 114 are connected to form the ball stem and bellows assembly 110, which is moveable as a single unit.

The tip of the ball stem 112 may be positioned to interface with an entrance of the venturi orifice 120. The position of the ball stem and bellows assembly 110 relative to the entrance of the venturi orifice 120 determines whether the valve 100 is open or closed, i.e., whether injection gas or fluid is allowed to flow through the valve 100. As described below in more detail, when the tip of the ball stem 112 interfaces with the entrance of the venturi orifice 120 so as to close the passageway, injection gas or fluid is prevented from flowing through the valve 100. Conversely, when the tip of the ball stem 112 is not integral with the entrance of the venturi orifice 120, the valve is to some extent open, and injection gas or fluid may flow through the valve 100. The venturi orifice 120 is shaped to allow pressure to be reduced at a stable rate, which is advantageous in a variety of applications, e.g., increasing flow through the orifice. Other orifices, such as a square edge orifice, may also be used.

The end of the venturi orifice 120 opposing the entrance is in communication with the hydraulic system 130. The hydraulic system 130 includes tubular device bellows 132, 134. The tubular device bellows 132, 134 are filled with liquid silicon, and are in communication with each other. The hydraulic system 130 provides a force on the tubular device 140 when the tubular device bellows 132,134 expand and contract. Other hydraulic pressure systems may be used in place of, or in addition to, the use of tubular device bellows 132,134, such as a system utilizing a piston. The illustrative hydraulic system 130 utilizing tubular device bellows 132, 134 operates like a piston. The hydraulic system 130 is bounded by a flow channel 136, which transports the injection gas or fluid from the venturi orifice 120 to the tubular device 140.

The end of the hydraulic system 130 opposing the venturi orifice 120 is connected to the tubular device 140. The tubular device 140 slides within the valve 100 to allow the flapper system 150 to open and close. The tubular device 140 is encased by a spring 142, which when pressed upon, allows the tubular device 140 to translate. The spring 142 biases the tubular device 140 toward the venturi orifice 120. When the valve 100 is in the closed position, as in FIG. 1, the tubular device 140 is pressed against the flapper system 150, with the flapper system 150 blocking the flow path of the injection gas or fluid, preventing the tubular device 140 from translating along the axis of the valve 100, and sealing the valve 100.

The flapper system 150 is a type of reverse-flow check valve mechanism, serving to prevent well fluids from flowing in a reverse direction through the valve 100. The flapper system 150 may include a flapper 150, soft seat 152, and hard seat 154. The seats 152, 154 of the flapper system 150 are positioned outside of the flow path and tubular device 140. Thus, when the tubular device 140 is moved to the left in the figures, the flapper 150 and seats 152, 154 are not subjected to the flow of the injection gas or fluid, which causes deterioration. In this regard, the flapper system 150 can provide a long-term, positive valve closure and sealing, with zero or minimal gas release after its closure.

In the illustrative example, the flapper 152 is formed of a metallic material, and is opened and closed using a hinge. The soft seat 154 is formed of a non-metallic material, such as a polymer. The hard seat 156 is formed of a metallic material. The optional soft seat 154 allows for sealing at minimal pressure differentials. One having ordinary skill in the art will appreciate that alternative materials may be used. In the illustrative example, the primary sealing is the metal-to-metal contact between the flapper 152 and the hard seat 156. The housing of the flapper system 150 is connected to the flow-thru latch 160, which is positioned on the end of the valve 100 opposing the ball stem and bellows assembly 110. When the valve 100 is in an open position, injection gas or fluid flows through the flow-thru latch and into the production tubing, where it mixes with crude oil or other fluid.

The operation of the valve 100 will now be described. As described above, the illustrative valve 100 controls the flow of injection gas or fluid that is mixed with crude oil or well fluid in a production tubing to reduce the density of the crude oil or well fluid, thus enhancing the production rate of the well. The injection gas or fluid is provided to the valve 100 via an annulus between the production tubing and well. Alternatively, the injection gas or fluid could be provided from control line connected with surface. The valve 100 connects to the production tubing via one or more mandrels distributed along the line.

The injection gas or fluid enters the valve 100 through inlet 170. Seals 180 provide the valve 100 with an isolation area between the seals 180, channeling the injection gas or fluid to the inlet 170. The bellows 114 of the ball stem and bellows assembly 110 may be filled, for example, with nitrogen charged gas. When the pressure of the injected gas or fluid exceeds the pressure in the nitrogen charged bellows 114, the nitrogen charged bellows contracts, and the ball stem 112, moving in conjunction with the bellows 114, is positioned so that the injection gas or fluid is able to enter the venturi orifice 120. Conversely, when the pressure of the injected gas or fluid is less than the pressure of the nitrogen charged bellows 114, the nitrogen charged bellows 114 expands, and the ball stem 112 mates with the opening of the venturi orifice 120, preventing the injection gas or fluid from entering the venturi orifice 120.

When the valve 100 is in the closed position, as depicted in FIG. 1, no injection gas or fluid flows through the venturi orifice 120. With no flow through the venturi orifice 120, the hydraulic system 130 is not actuated. In this state, the tubular device 140, connected to the hydraulic system 130, is positioned in the valve 100 towards the end with the ball stem and bellows assembly 110, as depicted in FIG. 1. The flapper system 150 is closed, with the flapper 152 being in the path of the tubular device, positively sealing the valve 100. With the flapper system 150 closed, the valve is protected from crude oil or well fluid flowing in the valve in the reverse direction from the flow path of the injection gas or fluid.

FIG. 2 depicts a schematic diagram of the valve of FIG. 1 when the valve 100 is in a half-open position. In this state, the pressure of the injected gas or fluid exceeds the pressure in the nitrogen charged bellows 114, moving the ball stem 112, in conjunction with the contracted bellows 114, away from the entrance of the venturi orifice 120, although the pressure of the injected gas or fluid is not so great as to completely avoid obstructing the entrance.

The injection gas or fluid flows through the venturi orifice 120 and actuates the hydraulic system 130. The entrance area of the hydraulic system, operating as a piston, may include a fluid filtering system to minimize the intrusion of contaminants to the operating piston sealing systems, thereby providing an increased sealing system operational life. Potential forms of filtering include sintered metal and wire mesh systems.

The flow from the venturi orifice 120 causes the tubular device bellows 134 of the hydraulic system 130 to contract, thereby forcing fluid into the tubular device bellows 132 which causes the tubular device bellows 132 to expand, resulting in a net translational expansion of the bellows 132, 134. Consequently, the hydraulic system 130, which is connected to the tubular device 140, forces the tubular device 140 to translate axially within the valve 200, in the direction towards the flapper assembly 150. After the injection gas or fluid leaves the venturi orifice and actuates the hydraulic system 130, the injection gas or fluid disperses through a flow channel 136 encasing the hydraulic system 130, and then recombines as it enters the tubular device 140.

The hydraulic system 130 including the tubular device bellows 134 operating as a piston and may contain one or more sealing elements or systems in one or more locations of its length. The sealing elements may be dynamic or static in nature, and may be of a metal, elastomeric, or plastic material, of a combination thereof. The sealing elements may be configured as o-rings, t-rings, or other pressure energized or non-pressure energized sealing designs.

The translation of the tubular device 140 can open the flapper system 150. Alternatively, the flow can open the flapper valve. Alternatively, the tubular device 140 and the flow can together open the flapper system 150. As shown in FIG. 2, the valve 100 is only partially open, and so the pressure actuating the hydraulic system 130, and the translation of the tubular device 140, are consequently not at a maximum. Accordingly, as depicted in FIG. 2, in this state the flapper system 150 is partially open, with the tubular device 140 forcing it open part way. The closing force of the valve 100 may be a mechanical spring or a pressure containing chamber such as a bellows or a combination thereof. An additional closure motivator is a pressure differential on the hydraulic system 130 in the direction to allow the flapper 152 to shift to the closed position via its torsion spring.

While the flapper system 150 is partially open, the valve 100 is protected from crude oil or well fluid from the production tubing flowing through the valve 100 in the reverse direction because the tubular device 140 is seated integral with the housing of the valve 100. With the flapper system partially open 150, the injection gas or fluid is able to traverse the flow-thru latch 160 and ultimately combine with crude oil or well fluid in the production tubing.

FIG. 3 depicts a schematic diagram of the valve of FIG. 1 when the valve 100 is in an open position. In this state, the pressure of the injected gas or fluid exceeds the pressure in the nitrogen charged bellows 114 to the extent that the ball stem 112 is positioned away from the entrance of the venturi orifice 120 to allow the injected gas or fluid to enter. As described above, the pressure of the injection gas or fluid that has traversed the venturi orifice 120 actuates the hydraulic system 130. In this state, the combination of the tubular device bellows 132,134 causes the tubular device 140 to translate through to the flapper 142 and completely open the flapper system 150. The injection gas or fluid flows through the tubular device 140, and the valve 100 is protected from reverse-flowing crude oil or well fluid by the integral tubular device seating within the housing of the valve 100. From the tubular device 140, the injection gas or fluid traverses the flow-thru latch 160 and ultimately combines with crude oil or well fluid in the production tubing.

Figure 4:
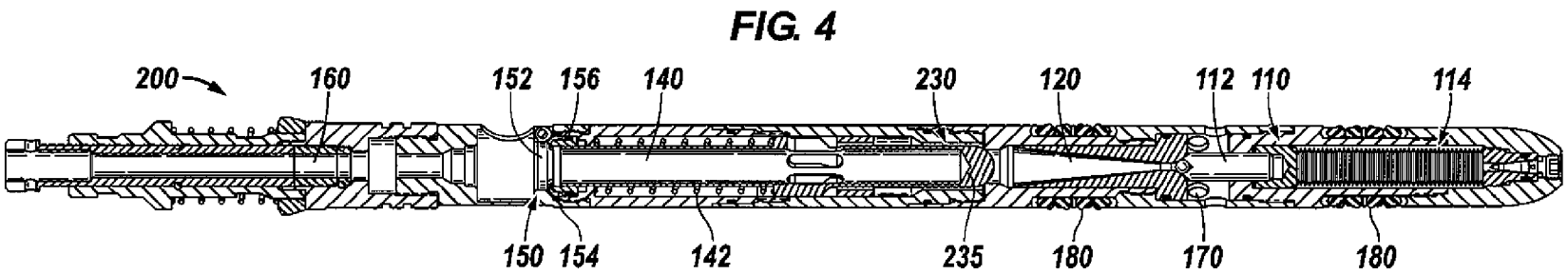
FIG. 4 is a schematic diagram of a valve shown in a closed position.
Figure 5:
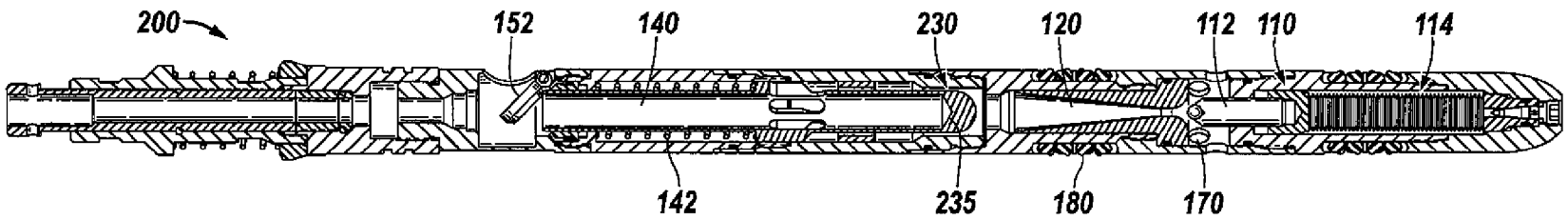
FIG. 5 is a schematic diagram of the valve of FIG. 4, shown in a half-open position.
Figure 6:
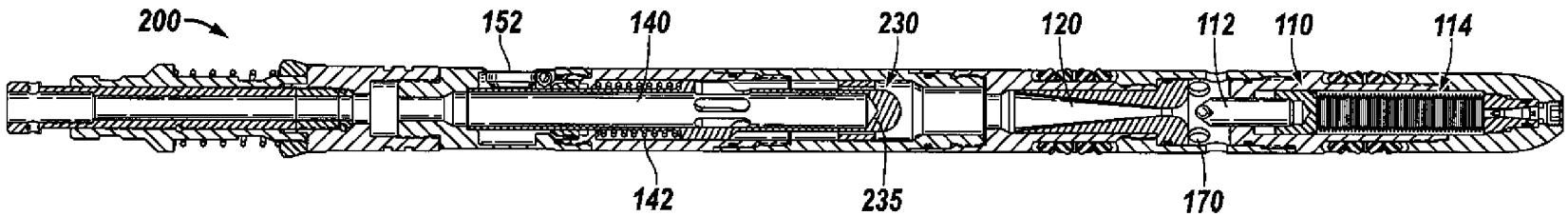
FIG. 6 is a schematic diagram of the valve of FIG. 4, shown in an open position.

FIGS. 4-6 depict schematic diagrams of a gas lift valve 200 according to an embodiment. FIG. 4 shows the valve 200 in a closed position. The valve 200 includes a ball stem and bellows assembly 110, venturi orifice 120, flow deflecting system 230, tubular device 140, flapper system 150, and flow-thru latch 160. Aside from the configuration and operation of the flow deflecting system 230, the remaining components of the valve 200 may be identical to corresponding components described with respect to illustrative valve 100.

The exit of the venturi orifice 120 is in communication with the flow deflecting system 230. The flow deflecting system 230 includes a flow deflector, e.g., a dart 235, that is shaped to obstruct/deflect the flow of the injection gas or fluid. The dart can have a rounded shape, but can also have many other profiles. The dart 235 is connected to the tubular device 140. When the flow deflecting system 230 is subjected to the flow of the injection gas or fluid, the dart 235 provides a force on the tubular device 140, causing it to translate axially within the valve 200, and allowing the tubular device 140 to open and close the flapper system 150. Other flow deflecting systems may be used in place of, or in addition to, the use of the dart 235.

In FIG. 4, the pressure of the injected gas or fluid is less than the pressure in the nitrogen charged bellows 114, and thus the valve 200 is closed. In this state, the ball stem 112 is mated with the entrance of the venturi orifice 120, preventing the injection gas or fluid from flowing throughout the valve 200. In this state, the flow deflecting system is not actuated, the tubular device is positioned towards the end of the valve 200 with ball stem and bellows assembly 110, and the flapper system 150 is closed.

FIG. 5 depicts a schematic diagram of the valve 200 of FIG. 4 when the valve 200 is in a half-open position. As described with respect to FIG. 2, in this state the pressure of the injected gas or fluid exceeds the pressure in the nitrogen charged bellows 114, and the ball stem 112 is positioned so that the injection gas or fluid is able to enter the venturi orifice 120, although the ball stem 112 is not completely clear from the entrance. The injection gas or fluid flows through the venturi orifice 120, with the pressure being reduced at a stable rate, and actuates the flow deflecting system 230. The flow deflects from dart 235, providing the force for the tubular device 140 to translate axially within the valve 200 in the direction towards the flapper system 150. As described above, the translation of the tubular device 140 and or the flow partially opens the flapper 152, and the injection gas or fluid traverses the flow-thru latch 160 and ultimately combines with crude oil or well fluid in the production tubing.

FIG. 6 depicts a schematic diagram of the valve of FIG. 4 when the valve 200 is in an open position. As described above with respect to FIG. 3, in this state the pressure of the injected gas or fluid exceeds the pressure of the nitrogen charged bellows 114, and the ball stem 112 is positioned sufficiently away from the entrance of the venturi orifice 120 to allow the injected gas or fluid to enter more freely than as depicted in FIG. 5. As described above, the injection gas or fluid flows through the venturi orifice 120, with the pressure being reduced to a stable rate, and actuates the flow deflecting system 230, providing the force for the tubular device 140 to translate axially and fully open the flapper 152, and allowing the injection gas or fluid to traverse the flow-thru latch 160 and ultimately combine with crude oil or well fluid in the production tubing.

Figure 7:
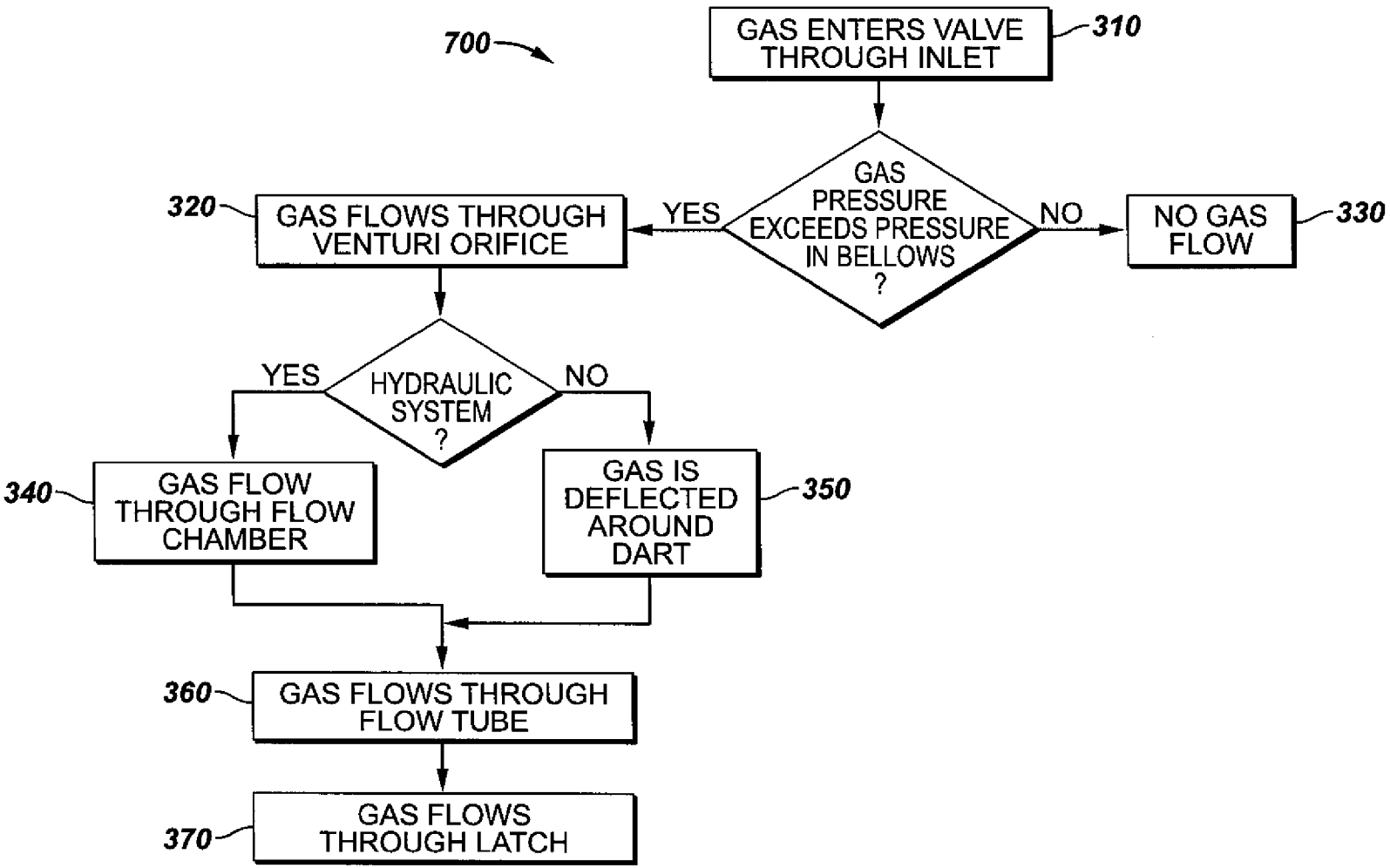
FIG. 7 is a flow diagram depicting the flow path of injection gas or fluid in the valve of FIG. 3 or FIG. 6.

FIG. 7 is a flow diagram depicting the flow path 300 of the injection gas or fluid as it traverses the valve 100 or valve 200, as described above. The injection gas or fluid enters valve 100 or valve 200 through inlet 170 (step 310). If the pressure of the injection gas or fluid exceeds the pressure of the nitrogen charged bellows 114, the injection gas or fluid flows through the venturi orifice 120 (step 320). If, however, the pressure of the injection gas or fluid does not exceed the pressure of the nitrogen charged bellows 114, the injection gas or fluid does not flow through the venturi orifice 120 (step 330) because the entrance is blocked by the ball stem 112, closing the valve 100.

Where the hydraulic system 130 is used, from the venturi orifice 120 the injection gas or fluid flows through flow channel 136 encasing the hydraulic system 140 (step 340). Where the flow deflecting system 230 is used, from the venturi orifice 120 the injection gas or fluid is deflected by and around the dart 235 (step 350). In both situations, the injection gas or fluid next flows through the tubular device 140 (step 360) and passes through the flapper system 150. The injection gas or fluid then flows through the flow-thru latch 160 (step 370), ultimately mixing with crude oil or well fluid in the production tubing.

The illustrative valves 100, 200 described above are able to be independently and selectively operated, with benefits similar to those of a surface controlled subsurface safety valve (SCSSV). The long-term, positive sealing flapper system 150 allows zero or minimal gas or fluid release upon closure, thereby providing a cost-effective, positive closing valve to dramatically reduce the potential for inadvertent hydrocarbon releases into the environment when well shut-in is required. Moreover, the annulus pressure operated designs are retrofitable into wells where applicable and serviceable side-pocket mandrels are present.

The above embodiments and descriptions allow the illustrative valves 100, 200 to open and close via an applied pressure and independently of a choke, or choke-like, flow-entering, pressure differential device. Moreover, the valves 100, 200 can use hydraulic pressure applied to either open or close the valves via one or more control lines or conduits that are connected from a hydraulic power source through independent conduits to effect movement of a piston assembly integral to the valve, which either moves the mechanism to the open or closed position depending upon the conduit selected or the count of the pressure cycles on the conduit. The valves 100, 200 can operate from a down hole casing pressure source or from a single or dual control line surface controlled conduit. The valve system can be used in all standard wireline retrievable gas lift configurations and is capable of installation in typical industry standard side pocket mandrels. The system can be installed in all standard gas lift completion configurations.

While various embodiments have been described, it will be apparent to those of skill in the art that many more embodiments and implementations are possible.

What is claimed is:

1. A gas lift valve, comprising:

a longitudinally extending tubular body defining an inner volume and an inner diameter;

a flow restrictor within the tubular body defining an opening there through having an inner diameter that is smaller than the inner diameter of the tubular body, thereby defining a first side of the flow restrictor and a second side of the flow restrictor;

a valve part located on the first side of the flow restrictor, the valve part being movable between a first position and a second position, the first position being in contact with the flow restrictor thereby restricting flow through the flow restrictor, and the second position not being in contact with the flow restrictor and allowing flow though the flow restrictor, the valve part being actuated by pressure on the first side of the flow restrictor;

an opening in the tubular body fluidly connecting an outside of the gas lift valve to an inside volume of the gas lift valve on the first side of the flow restrictor;

a longitudinally extending tubular device located inside the tubular body on the second side of the flow restrictor, the tubular device being longitudinally movable inside the tubular body;

a flow deflector located on the second side of the flow restrictor, the flow deflector being mechanically connected with the tubular device so that the flow deflector and the tubular body move in tandem;

a flapper valve located within the tubular body and adjacent to an end of the tubular device that is distal from the flow restrictor, the flapper valve having a first closed position wherein the flapper valve covers an opening though the tubular body, and a second open position wherein the flapper valve allows flow though the tubular body; wherein when in the first position the tubular device is proximate to the flow restrictor thereby allowing the flapper valve into the first closed position covering the opening and when the tubular device is in the second position the tubular device extends though the opening and is distal to the flow restrictor thereby preventing the flapper valve from moving to the first closed position.

2. The gas lift valve of claim 1, wherein the flow deflector device comprises a bellows that expands when exposed to force from fluid traveling though the flow restrictor.

3. The gas lift valve of claim 1, wherein the flow deflector device comprises a bellows that contracts when exposed to force from the fluid traveling though the flow restrictor.

4. The gas lift valve of claim 1, wherein the flow deflector device comprises a first bellows that is contracted when exposed to force from the fluid traveling through the flow restrictor, and a second bellows that is in fluid communication with the first bellows and extends longitudinally when the first bellows contracts.

5. The gas lift valve of claim 1, wherein the flow deflector is centrally located in the flow-path of fluid traveling through the flow restrictor and receives force from the fluid traveling through the flow restrictor thereby driving the flow deflector away from the flow restrictor.

6. The gas lift valve of claim 2, wherein when the bellows expands the tubular device is moved away from the flow restrictor toward the second position by way of the mechanical connection between the flow deflector and the tubular device.

7. The gas lift valve of claim 4, wherein when the second bellows expands the tubular device is moved away from the flow restrictor toward the second position by way of the mechanical connection between the flow deflector and the tubular device.

8. The gas lift valve of claim 5, wherein when the flow deflector is driven away from the flow restrictor, the tubular device is moved toward the second position by way of the mechanical connection between the tubular device and the flow deflector.

9. The gas lift valve of claim 1, wherein the valve part is actuated by pressure.

10. The gas lift valve of claim 1, wherein the valve part comprises a bellows.

11. The gas lift valve of claim 1, wherein the valve part comprises a piston.

12. The gas lift valve of claim 1, wherein the valve part comprises a bladder.

13. The gas lift valve of claim 1, wherein the opening is connected to a conduit that connects to surface.

14. The gas lift valve of claim 1, wherein the opening is connected with an annulus between a completion and within a casing.

15. The gas lift valve of claim 1, wherein the flow restrictor is a venturi orifice.

16. A gas lift valve, comprising:

an orifice that receives injection fluid;

a flow restrictor that is fluidly connected with the orifice;

a flow deflector that is located on a side of the flow restrictor opposite to the orifice;

a tubular device that is mechanically connected with the flow deflector wherein the tubular device and the flow deflector move in tandem, the tubular device having a first position and a second position;

a flapper valve having an open position and a closed position, wherein the closed position covers an opening and prevents flow through the gas lift valve; wherein when the tubular device is in the first position the flapper valve is biased toward the closed position and covers the opening, and when the tubular device is in the second position the tubular device extends through the opening thereby preventing the flapper valve from moving into the closed position; and a valve part located on a first side of the flow restrictor that is opposite to a side of the flow restrictor where the flow deflector is located, the valve part being movable between a first position in contact with the flow restrictor thereby restricting flow through the flow restrictor and a second position not in contact with the flow restrictor thereby allowing flow though the flow restrictor, the valve part being actuated by pressure on the first side of the flow restrictor.

17. A method of actuating a gas lift valve having a longitudinally extending tubular body defining an inner volume and an inner diameter;

a flow restrictor within the tubular body defining an opening there through having an inner diameter that is smaller than the inner diameter of the tubular body, thereby defining a first side of the flow restrictor and a second side of the flow restrictor;

a valve part located on the first side of the flow restrictor, the valve part being movable between a first position and a second position, the first position being in contact with the flow restrictor thereby restricting flow through the flow restrictor, and the second position not being in contact with the flow restrictor and allowing flow though the flow restrictor, the valve part being actuated by pressure on the first side of the flow restrictor;

an opening in the tubular body fluidly connecting an outside of the gas lift valve to an inside volume of the gas lift valve on the first side of the flow restrictor;

a longitudinally extending tubular device located inside the tubular body on the second side of the flow restrictor, the tubular device being longitudinally movable inside the tubular body;

a flow deflector located on the second side of the flow restrictor, the flow deflector being mechanically connected with the tubular device so that the flow deflector and the tubular body move in tandem;

a flapper valve located within the tubular body and adjacent to an end of the tubular device that is distal from the flow restrictor, the flapper valve having a first closed position wherein the flapper valve covers an opening though the tubular body, and a second open position wherein the flapper valve allows flow though the tubular body; wherein when in the first position the tubular device is proximate to the flow restrictor thereby allowing the flapper valve into the first closed position covering the opening and when the tubular device is in the second position the tubular device extends though the opening and is distal to the flow restrictor thereby preventing the flapper valve from moving to the first closed position, comprising:

providing a flow of fluid into the opening and into the volume at the first side of the flow restrictor with a pressure that moves the valve part to the open position, the flowing the fluid through the flow restrictor and contacting the flow deflector thereby moving the tubular device to the second position and moving the flapper valve into an open position.

18. The method of claim 17, comprising providing the fluid by way of an annulus between a casing and a completion within the casing.

* * * * *